US007563551B2

(12) United States Patent
Spector et al.

(10) Patent No.: US 7,563,551 B2
(45) Date of Patent: Jul. 21, 2009

(54) PRINTING A LIGHT EMITTING ELEMENT

(75) Inventors: Tomer Spector, Neve Monoson (IL); Yaron Grinwald, Gedera (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 410 days.

(21) Appl. No.: 11/259,795

(22) Filed: Oct. 27, 2005

(65) Prior Publication Data

US 2006/0093936 A1 May 4, 2006

(30) Foreign Application Priority Data

Oct. 29, 2004 (GB) ..... 0424136.0

(51) Int. Cl.
*G03G 9/00* (2006.01)

(52) U.S. Cl. ..... 430/114; 430/120.2; 430/123.5

(58) Field of Classification Search ..... 430/108.1, 430/114, 120.2, 123.5
See application file for complete search history.

(56) References Cited

U.S. PATENT DOCUMENTS

| | | | | |
|---|---|---|---|---|
| 4,865,937 | A * | 9/1989 | Santilli et al. | 430/137.18 |
| 4,877,699 | A * | 10/1989 | Young et al. | 430/54 |
| 4,902,929 | A | 2/1990 | Toyoda et al. | |
| 2007/0010672 | A1 * | 1/2007 | Yamamoto et al. | 544/333 |

* cited by examiner

*Primary Examiner*—Mark A Chapman

(57) ABSTRACT

A charged toner particle for use in printing a light emitting device, the particle comprising: a polymer; and electroluminescent particles dispersed in the polymer, wherein when the toner is printed the electroluminescent particles in the printed toner are spatially substantially static.

25 Claims, 1 Drawing Sheet

PRINTING A LIGHT EMITTING ELEMENT

CROSS-REFERENCE TO RELATED APPLICATIONS

This application incorporates by this reference all subject matter contained in Patent Application Serial No. 0424136.0, as filed in the United Kingdom on 29 Oct. 2004, and entitled "Printing a Light Emitting Element". Further, the benefit of the filing date of such application is claimed to the fullest extent permitted by 35 U.S.C. § 119.

FIELD OF THE INVENTION

The invention relates to methods of printing a visual display and in particular to printing such a display using an electrostatographic printing method.

BACKGROUND OF THE INVENTION

Methods for printing images by depositing patterns of materials—inks or toners—on substrates are well known. These methods are generally fast, inexpensive and suitable for printing a very large number of copies of an image rapidly. Depending on the printing method, printing resolution may be as fine as ten or a few tens of microns. Photolithography methods for producing modern integrated circuitry are methods for depositing patterns of materials on substrates and typically provide pattern deposition resolutions that are better than a few tenths of a micron. However, these methods are extremely expensive, slow and complicated compared to printing methods.

Whereas pattern resolution equal to and better than a few tenths of a micron are required for producing very fast integrated circuits, there are many applications for which substantially lower resolution is sufficient. For example, for producing TV and flat panel displays, circuit manufacturing techniques having pattern resolutions of about 10-20 microns are often sufficient. For simple circuits, such as those used in toys, even less stringent resolutions may be sufficient. Therefore, if printing techniques that are used to print images at resolutions of about ten microns or a few tens of microns can be adapted to print materials suitable for producing electronic components and display elements, circuitry, such as video displays could be produced in large quantities at costs that are small fractions of current costs.

Different approaches for printing circuitry are under investigation and printing inks of various kinds suitable for, for example, screen, gravure, offset, electrostatic, ink-jet and micro-contact printing of circuit elements are under development.

U.S. Pat. No. 6,300,932 entitled "Electrophoretic Displays with Luminescent Particles and Materials for Making the Same", the disclosure of which is incorporated herein by reference, describes electrophoretic, optoelectronic materials suitable for printing optically active regions of pixels in a display. In such a material at least some "particles are moved or rotated by application of electric fields" to change an optical property of the material.

U.S. Pat. No. 6,274,412, the disclosure of which is incorporated herein by reference, describes using printing techniques to manufacture an active matrix liquid crystal display (AMLCD). However, printing is limited to electrostatic printing of metal conductors for gate and data lines of the array and Indium Tin Oxide (ITO) pixel electrodes. Semiconducting components of thin film transistors (TFT) used to control the matrix were described as being produced by plasma enhanced chemical vapor deposition (PECDV).

SUMMARY OF THE INVENTION

An aspect of some embodiments of the present invention relates to providing a toner that can be printed using an electrostatographic printing process to produce regions of pixels in a display that are controllable by an electric field to emit light. Electrostatographic printing processes include electrophotographic and other electrostatic printing processes in which electrostatic fields, with or without time varying perturbations or modulations, are used to transport toner particles to form an image. Some examples of such processes are various types of electrophotographic printing, such as by liquid toner electrophoresis or full or partial thickness layerwise transfer of concentrated toner layers.

In accordance with an aspect of some embodiments of the invention, the toner comprises charged toner particles comprising a polymer in which an electroluminescent powder is dispersed. The powder comprises a luminescent material that can be stimulated by an AC or DC electric field to emit light in a non-electrophoretic process, i.e. a process that does not involve motion of components of the material in order for the material to emit light in response to the electric field. Optionally, the toner is a liquid toner and the charged toner particles are dispersed in a carrier liquid. When the toner is printed and dried on a suitable substrate and a region of the dry toner is stimulated by an electric field, the luminescent material in the toner does not move or rotate in order for the region to emit light.

Optionally, the liquid toner is produced using a method adapted from methods used to produce pigmented electrostatographic toners. In such an adapted method, during production of the toner, a procedure for adding pigment to produce a pigmented toner, is replaced by a procedure for adding an optoelectronic powder to the toner.

There is therefore provided in accordance with an embodiment of the present invention, a charged toner particle for use in printing a light emitting device, the particle comprising: a polymer; and electroluminescent particles dispersed in the polymer, wherein when the toner is printed the electroluminescent particles in the printed toner are spatially static.

Optionally, the particle has a relatively flat body from which relatively elongate tentacles extend.

Optionally, the electroluminescent particles comprise at least one type of particle chosen from the group consisting of particles of: Zn:Mn; CaSSe:Eu; ZnS:TbOF; SrS:Ce; $SrGa_2S_4$:Ca; $CaGa_2S_4$:Ca; and SrS:Cu.

In some embodiments of the invention, the concentration of the electroluminescent particles is from 25% to 70% by weight of the non-volatile solids in the toner particle. Optionally, the concentration of the electroluminescent particles is from 35% to 60% by weight of the non-volatile solids in the toner particle. Optionally, the concentration of the electroluminescent particles is from 45% to 55% by weight of the non-volatile solids in the toner particle. Optionally, the concentration of the electroluminescent particles is about 50% by weight of the non-volatile solids in the toner particle.

Optionally, the polymer comprises at least one material chosen from the group consisting of: Ethylene acrylic acid and methacrylic acid copolymer resin; Ethylene acrylic acid copolymer resin; Acid-modified ethylene acrylate copolymer resin; Copolymer of Ethylene—Glycidyl Methacrylate; Terpolymer of Ethylene—Methyl Acrylate—Glycidyl Methacrylate; and Terpolymer of Ethylene—Ethyl Acrylate—Maleic Anhydride.

Optionally, the toner particles according are dispersed in a carrier liquid. Optionally, the particle has a relatively flat body from which relatively elongate tentacles extend.

There is further provided in accordance with an embodiment of the invention, a method of producing a device controllable to emit light comprising: forming at least one first electrode on a substrate; printing a layer of toner particles according to an embodiment of the invention over at least a portion of the at least one first electrode using an electrostatographic printing process; and forming at least one second electrode over at least a portion of the toner layer; wherein the layer of toner may be caused to emit light by applying a time varying voltage between the first and second electrodes.

Optionally, the electroluminescent particles comprise at least one type of particles chosen from the group consisting of particles of: Zn:Mn; CaSSe:Eu; ZnS:TbOF; SrS:Ce; $SrGa_2S_4$:Ca; $CaGa_2S_4$:Ca; and SrS:Cu.

In some embodiments of the invention, the concentration of the electroluminescent particles is from 25% to 70% by weight of the non-volatile solids in the toner particles.

Optionally, the concentration of the electroluminescent particles is from 35% to 60% by weight of the non-volatile solids in the toner particles. Optionally, the concentration of the electroluminescent particles is from 45% to 55% by weight of the non-volatile solids in the toner particles. Optionally, the concentration of the electroluminescent particles is about 50% by weight of the non-volatile solids in the toner particles.

Optionally, the polymer comprises at least one material chosen from the group consisting of: Ethylene acrylic acid and methacrylic acid copolymer resin; Ethylene acrylic acid copolymer resin; Acid-modified ethylene acrylate copolymer resin; Copolymer of Ethylene—Glycidyl Methacrylate; Terpolymer of Ethylene—Methyl Acrylate—Glycidyl Methacrylate; and Terpolymer of Ethylene—Ethyl Acrylate—Maleic Anhydride.

Optionally, the toner particles are dispersed in a carrier liquid.

Optionally, printing comprises forming a layer of the toner particles and transferring the layer to cover at least a portion of the at least one first electrode. Optionally, forming the toner layer comprises heating the toner particles so that they coalesce. Optionally, forming the toner layer comprises forming the layer on an intermediate transfer member of an electrostatographic printing press.

Optionally, forming the at least one first electrode comprises printing the at least one first electrode. Optionally, printing the at least one first electrode comprises electrostatographic printing. Optionally, forming the at least one second electrode comprises printing the at least one second electrode. Optionally, printing the at least one second electrode comprises electrostatographic printing.

BRIEF DESCRIPTION OF FIGURES

Non-limiting examples of embodiments of the present invention are described below with reference to a figure attached hereto. Dimensions of components and features in the figure are chosen for convenience and clarity of presentation and are not necessarily shown to scale. The figure is.

DETAILED DESCRIPTION OF EXEMPLARY EMBODIMENTS

Figure 1:
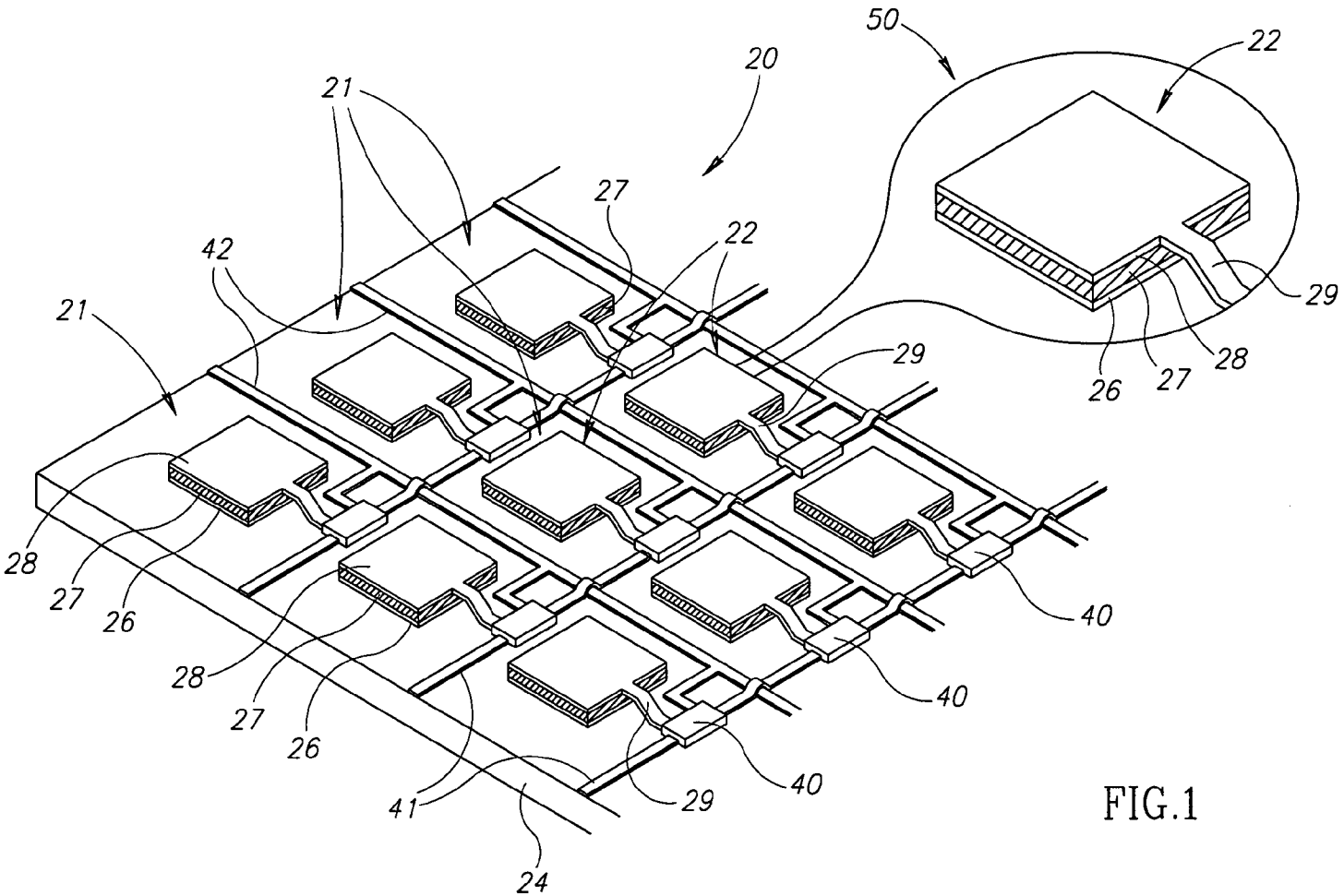
FIG. 1 schematically shows a flat panel display comprising light emitting elements (LEEs) produced by printing an optoelectronic toner, in accordance with an embodiment of the invention.

Various methods known in the art to produce a toner suitable for use in an electrostratographic printing method may be adapted to produce a toner in accordance with an embodiment of the invention.

By way of example, a toner in accordance with an embodiment of the invention may be prepared by mixing a suitable polymer together with a quantity of a carrier liquid so that the carrier liquid is between about 25% to 40% by weight of the mixture. Optionally, the polymer comprises one or more polymers chosen from the group consisting of: Ethylene acrylic acid and methacrylic acid copolymer resin; Ethylene acrylic acid copolymer resin; Acid-modified ethylene acrylate copolymer resin; Copolymer of Ethylene—Glycidyl Methacrylate; Terpolymer of Ethylene—Methyl Acrylate—Glycidyl Methacrylate; and Terpolymer of Ethylene—Ethyl Acrylate—Maleic Anhydride. Optionally, the polymer comprises Nucrell 699 and/or Bynel 2022, manufactured by Du Pont. Optionally, the carrier liquid comprises Isopar L manufactured by EXXON.

The ingredients are loaded into a mixer, such as a Ross mixer, and mixed for between about 0.5 to about 2.5 hours at a temperature of about 110° C. to produce a slurry comprising polymer particles plasticized by solvation with the carrier liquid. During a following additional period of mixing, the slurry is allowed to cool to room temperature. The slurry is then ground for about eight hours together with a charge adjuvant (e.g. Aluminum Tristearate) at a temperature of between about 20° C. to about 55° C. in an attritor loaded with 3/16" carbon steel balls as grinding medium. At the end of the grinding period the mixture comprises polymer particles having a relatively flat body from which relatively elongate appendages or "tentacles" extend.

An optoelectronic powder is added to the toner particle mixture in an amount so that after addition it accounts for from 25% to 70% by weight of the non-volatile solids in the slurry. Optionally, the powder accounts for from 35% to 60% by weight of the non-volatile solids. Optionally, the powder accounts for from 45% to 55% by weight of the non-volatile solids. In some embodiments of the invention, the powder accounts for about 50% by weight of the non-volatile solids. The mixture of slurry and powder is high shear mixed for a few minutes to percolate the powder through the toner particles. A charge director, as known in the art is then added and mixed with the toner particle mixture to charge the toner particles. The result of the process is an optoelectronic toner concentrate to which additional carrier liquid and charge director are added as required to provide an optoelectronic toner that is suitable for printing and has a desired concentration of non-volatile solids.

Optoelectronic powders suitable for the practice of the present invention are, by way of example, powders of: Zn:Mn (yellow); CaSSe:Eu (red); ZnS:TbOF (green); SrS:Ce (green); $SrBa_2S_4$:Ca (blue); $CaGa_2S_4$:Ca (blue); SrS:Cu (blue). The color in parentheses following the chemical definition of each powder is the color light that the powder provides when excited. In some embodiments of the invention, a Glacierglo™ phosphor powder provided by Osram Sylvania is used to provide an optoelectronic toner. Different Glacierglo™ powders are available for providing different color light. Optionally, the powder comprises a Glacierglo™ High Brite powder, different types of which may be used to provide orange, blue/green, blue, green light and white light. Optionally, the powder is Glacierglo™ GG23 High Brite, which provides blue/green light when excited.

An optoelectronic toner, in accordance with an embodiment of the invention, may be printed on a substrate to provide a display having a pattern of pixels comprising light emitting elements (LEEs) that have relatively sharply and accurately defined "optoelectronic" regions selectively controllable to luminesce responsive to electric fields generated by an addressable configuration of electrodes. During printing of the toner, for example using an electrostatographic printer such as an Hewlett-Packard Indigo press, optoelectronic, charged toner particles are electrostatically adhered to a photosensitive surface, referred to as a "photosensitive imaging plate" (PIP), of a cylindrical roller in a desired pattern, referred to as a latent image, to be transferred to a substrate. Toner is applied to the latent image by a developer and the developed image transferred to the substrate. Optionally, the developed image is transferred to the substrate by first transferring the toner from the PIP to an intermediate transfer member (ITM) of the press and from the ITM to the substrate. On the ITM, the toner undergoes heating which causes the toner particles in the pattern to coalesce into a relatively smooth, continuous (within the "developed" area) layer or film. Along edges of the pattern, surface tension causes tentacles of toner particles to recede into and be absorbed into the bodies of the toner particles so that the edges are smooth and well defined. As noted above use of an ITM is optional, and depending on resolution provided by the printer, printing can be performed directly from the PIP to the substrate. However, it is believed that the "film forming capability" of the ITM results in an improved printed pattern.

Resolution of the printed pattern as good as 20 microns can be achieved using a conventional electrostatographic printer such as the Hewlett-Packard Indigo press noted above. The inventors feel that pattern resolutions as good as 5-10 microns can be provided by modified versions of such printers. Resolution improving modifications to a Hewlett-Packard Indigo press might include generating latent images on the printer's PIP using a scanning laser beam that is focused to a smaller than conventional spot on the PIP, and/or using a PIP having thinner charge generating layers and/or decreasing space between the PIP and the printer's developer. In addition, optionally, to provide high resolution printed patterns, toners comprising toner particles that are smaller than conventional sized toner particles are produced to print the patterns. Optionally, "high-resolution" toners comprise toner particles that have diameters of about a micron or less.

The pixel pattern of a display printed in accordance with an embodiment of the invention is therefore characterized by having LEEs each of which comprises a relatively accurately formed, well-resolved optoelectronic region. The optoelectronic region comprises optoelectronic powder particles dispersed and immobilized in solid polymer that forms an insulating medium with a relatively high dielectric constant. In some embodiments of the invention, an AC electric field is used to excite the optoelectronic region to luminesce. When the AC field is applied to the optoelectronic region, the field excites the particles to luminesce in a non-electrophoretic process. The electric field that each optoelectronic particle sees is amplified by a ratio of the dielectric constant of the polymer divided by the dielectric constant of the material comprised in the particle. In some embodiments of the invention, a DC field is used to excite an optoelectronic region printed in accordance with an embodiment of the invention to luminesce. The DC field generates a DC current in the optoelectronic region that excites the luminescence.

The inventors have produced an experimental light emitting element using a toner comprising Glacierglo™ GG23, in accordance with an embodiment of the invention. The toner was produced using a method similar to that described above, in which an amount of the Glacierglo™ GG23 was mixed with the toner so that it accounted for about 50% by weight of the nonvolatile solids in the toner. To produce the device, an aluminum electrode was formed by gluing a strip of aluminum foil to a piece of glass. A layer of toner particles about 30 microns thick was formed on the aluminum electrode by sandwiching a quantity of the toner between the aluminum electrode and a "transfer" electrode and applying a voltage between the electrodes that caused toner particles in the toner to migrate and adhere to the aluminum electrode. The aluminum electrode and adhered layer of toner particles were separated from the transfer electrode and heated to above 80° C. to fuse the polymer. A transparent electrode less than a micrometer thick was formed on the fused layer of toner by forming a layer of PEDOT (polyethylenedioxithiophene) marketed under the trade name Baytron, a conducting polymer marketed by BAYER Chemical and Drug Company of Leverkusen Germany, on the toner layer. Baytron is transparent to light emitted by Glacierglo™ GG23 when excited.

The inventors found that by applying an AC voltage between the transparent electrode and the aluminum electrode, the device could be excited to radiate blue/green light through the transparent electrode.

While the experimental device was not formed by printing the electroluminescent toner, the process used in producing the device demonstrates many of the features that make it possible to print a light emitting device and other semiconductor devices using an electrostatographic printing processes and variations of such processes. For example, toner layers having thicknesses of between 1 and 10 microns thick are readily printed using a conventional Hewlett-Packard Indigo press. Thicker layers, such as a 30 micron layer of optoelectronic toner particles, are optionally produced by overprinting a region more than once with an optoelectronic toner comprising the particles.

FIG. 1 schematically shows a portion of an exemplary flat panel display 20 having pixels 21 comprising LEEs 22 that have optoelectronic regions printed in accordance with an embodiment of the invention. Display 20 is, by way of example an active matrix flat panel display (AMFPD) formed on a substrate 24, which may for example be a glass, plastic or silicon wafer, and each pixel 21 comprises a thin film transistor (TFT) 40 that controls LEE 22 comprised in the pixel.

In an AMFPD display similar to that shown in FIG. 1 having a resolution of about 600 lines per inch, each pixel 21 has a size of about 40 microns by about 40 microns. TFTs 40 may be formed having different size footprints and if formed by conventional means may be made much smaller than LEEs 22. If formed by a printing process, a minimum footprint of a TFT is in general a function of resolution of the printing process. However, as discussed below, in accordance with an embodiment of the invention, a TFT may be formed on or below a LEE it controls. In such a case, the size of the footprint of a TFT does not substantially affect the size of the footprint of its LEE and the LEE and its TFT may each have a footprint substantially equal to of the size of a pixel in which they are located. For convenience of presentation in AMFPD 20, LEEs 22 and TFTs 40 are shown located beside each other in the respective pixels 21 that they occupy rather than arranged, one above the other.

TFTs 40 are coupled to row and column address lines 41 and 42 respectively for selectively addressing each TFT 40 and controlling the TFT to connect its associated pixel 22 to a source (not shown) of AC or DC power that excites the pixel to emit light. Whereas TFTs 40 are positioned beside their respective pixels 22 in display 20, spatial configurations for pixels and TFTs other than that shown in FIG. 1 are possible and can be advantageous. For example, TFTs in a display in accordance with an embodiment of the invention can be located beneath their associated LEEs. The TFTs may be produced in a layer formed below the LEEs and be connected to the LEEs by a suitable configuration of conductors and/or vias. Or, the TFTs can be formed on a side of the substrate opposite to the side on which the LEEs are formed and connected to the LEEs by vias. An AMFPD configuration in which TFT are stacked on the LEEs that they control is shown in a US application entitled "Printing Semiconducting Components", filed on even date with the present application, the disclosure of which is incorporated herein by reference.

Each LEE 22, which is shown greatly enlarged in an inset 50, comprises a layer 27 of an optoelectronic material sandwiched between first and second electrodes 26 and 28. Optionally, layer 27 has a thickness of between 1-10 microns and possibly even less than a micrometer. Thickness of layer 27 is a function of the material used and its electrical and optical properties and is optionally between about 1 micron and 10 microns thick. Such thicknesses and greater thicknesses are within the range of liquid toner printing techniques, either by using standard techniques, by using lower charge/unit mass toner or as required by printing multiple layers.

First electrode 26 is optionally a ground electrode and is formed from a suitable material such as a metal or a conducting polymer, using any appropriate etching or deposition technology for forming a conductor on a substrate. Optionally, first electrodes 26 are printed using any of various printing methods and materials known in the art, such as for example, silkscreen printing, electrostatographic printing, thermal printing or ink jet printing. Methods of printing electrodes are described in U.S. Pat. No. 6,521,489 or 6,300,932, the disclosures of which are incorporated herein by reference. Optionally, first electrodes 26 are about a micron thick. In some embodiments of the invention, electrodes 26 are a fraction of a micron thick.

Optionally, first electrode 26 for each LEE 22 is a separate individual conducting region on substrate 24. In some embodiments of the invention, the first electrode of each LEE 22 is a localized region of a layer of conducting material that covers all of substrate 24. For convenience of presentation, first electrodes 26 in display 20 are shown as separate individual conducting regions on substrate 24 and connectors that connect the electrodes to ground are not shown.

Optoelectronic layer 27 of each LEE 22 is formed as noted above by printing an optoelectronic toner in accordance with an embodiment of the invention using an electrostatographic printing process. Second electrode 28 is formed from a conducting material that is substantially transparent to visible light in at least a portion of the visible spectrum that optoelectronic layer 27 emits when excited. Such conductor materials and methods for applying them in desired patterns are well known in the art. Optionally, electrodes 28 have submicrometer thickness and are formed by printing optionally, ITO (indium tin oxide), ATO (aluminum tin oxide) or a transparent conductive polymer such as "Baytron".

Second electrode 28 is electrically connected to its associated TFT 40 by a conducting tab 29 that is optionally an integral part of and formed simultaneously with the formation of the second electrode. Optionally, a connector, such as tab 29, that connects each second electrode 28 to its TFT is formed after second electrodes are produced, optionally in a printing process, separate from that used to produce the electrodes. TFT 40 may be fabricated using any suitable material and deposition or etching processes known in the art, such as methods and materials described in U.S. Pat. No. 6,274,412, the disclosure of which is incorporated herein by reference. TFTs 40 are optionally fabricated using an electrostatographic printing method and a semiconducting toner described in US patent application entitled "Printing Semiconducting Components", referenced above.

Row and column address lines 41 and 42 for controlling TFTs 40 may be produced using any of the methods noted above for producing first and second electrodes 26 and 28. Row address lines 41 are prevented from making direct electrical contact with column address lines 42, optionally, by insulating material that overlays the column address lines at crossover regions of the row address lines with the column address lines. The insulating material, which is not shown, is optionally printed, for example using a silk screen process, over column address lines 42. Optionally, the insulating layer is a layer of an insulating polymer, such as Nucrel 699 or Bynell 2022, printed electrostatographically. Row address lines 41 "overpassing" column address lines 42 indicate the isolation of the row address lines from the column address lines.

It is noted that in FIG. 1, layers in LEEs 22 are shown with edges of a layer of material printed over an underlying layer perfectly aligned with the edges of the underlying layer. However, if an upper layer of material is printed over a lower layer with its edges aligned with edges of the lower layer, material in the upper layer will have a tendency to drip or flow over the edges of the underlying layer. Unless such dripping or overflowing is desired, the upper layer may, in accordance with an embodiment of the invention, be printed so that edges of the printed upper layer are recessed from the edges of the lower layer. For LEEs 22, for example, it is required to prevent material in electrode layer 28 from dribbling over underlying layers on which it is printed and making electrical contact with electrode layer 26. As a result, electrode layer 28 is printed, in accordance with an embodiment of the invention, with its edges recessed from edges of the underlying layers (e.g. optoelectronic layer 27).

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

The invention claimed is:

1. A liquid electrophotogaphy toner comprising:

a charged toner particle for use in printing a light emitting device, the particle further comprising:

a polymer; and electroluminescent particles dispersed in the polymer, wherein when a toner is printed, the electroluminescent particles in a printed toner are spatially static, wherein the electroluminescent particle comprises at least one type of an optoelectronic powder.

2. A toner particle according to claim 1 wherein the particle has a relatively flat body from which relatively elongate tentacles extend.

3. A toner particle according to claim 1 wherein the optoelectronic powder comprise at least one type of particle chosen from the group consisting of particles of: Zn:Mn; CaSSe:Eu; ZnS:TbOF; SrS:Ce; $SrGa_2S_4$:Ca; $CaGa_2S_4$:Ca and SrS:Cu.

4. A toner particle according to claim 1 wherein the concentration of the electroluminescent particles is from 25% to 70% by weight of the non-volatile solids in the toner particle.

5. A toner particle according to claim 1 wherein the concentration of the electroluminescent particles is from 35% to 60% by weight of the non-volatile solids in the toner particle.

6. A toner particle according to claim 1 wherein the concentration of the electroluminescent particles is from 45% to 55% by weight of the non-volatile solids in the toner particles.

7. A toner particle according to claim 1 wherein the concentration of the electroluminescent particles is about 50% by weight of the non-volatile solids in the toner particle.

8. A toner particle according to claim 1 wherein the polymer comprises at least one material chosen from the group consisting of:

Ethylene acrylic acid and methacrylic acid copolymer resin;

Ethylene acrylic acid copolymer resin;

Acid-modified ethylene acrylate copolymer resin;

Copolymer of Ethylene—Glycidyl Methacrylate;

Terpolymer of Ethylene—Methyl Acrylate-Clycidyl Methacrylate;

Terpolymer of Ethylene—Ethyl Acrylate—Glycidyl Methacrylate; and

Terpolymer of Ethylene—Ethyl Acrylate—Maleic Anydride.

9. A toner comprising toner particles according to claim 1 dispersed in a carrier liquid.

10. A toner according to claim 9 wherein the particle has a relatively flat body from which relatively elongate tentacles extend.

11. A method of producing a device controllable to emit light comprising:

forming at least one first electrode on a substrate;

printing a layer of toner particles according to claim 1 over at least a portion of the at least one first electrode using an electrostatographic printing process; and forming at least one second electrode over at least a portion of the toner layer;

wherein the layer of toner may be caused to emit light by applying a time varying voltage between the first and second electrodes.

12. A method according to claim 11 wherein the optoelectronic powder comprise at least one type of particles chosen from the group consisting of particles of: Zn:Mn; CaSSe:Eu; ZnS:TbOF; SrS:Ce; $SrGa_2S_4$:Ca; $CaGa_2S_4$:Ca; and SrS:Cu.

13. A method according to claim 11, wherein the concentration of the electroluminescent particles is from 35% to 70% by weight of the non-volatile solids in the toner particles.

14. A method according to claim 11 wherein the concentration of the electroluminescent particles is from 35% to 60% by weight of the non-volatile solids in the toner particles.

15. A method according to claim 11 wherein the concentration of the electroluminescent particles is from 45% to 55% by weight of the non-volatile solids in the toner particles.

16. A method according to claim 11 wherein the concentration of the electroluminescent particles is about 50% by weight of the non-volatile solids in the toner particles.

17. A method according to claim 11 wherein the polymer comprises at least one material chosen from the group consisting of:

Ethylene acrylic acid and methacrylic acid copolymer resin;

Ethylene acrylic acid copolymer resin;

Acid-modified ethylene acrylate copolymer resin;

Copolymer of Ethylene—Glycidyl Methacrylate;

Terpolymer of Ethylene—Methyl Acrylate—Glycidyl Methacrylate; and

Terpolymer of Ethylene—Ethyl Acrylate—Maleic Anhydride.

18. A method according to claim 11 wherein the toner particles are dispersed in a carrier liquid.

19. A method according to claim 17 wherein printing comprises forming a layer of the toner particles and transferring the layer to cover at least a portion of the at least one first electrode.

20. A method according to claim 19 wherein forming the toner layer comprises heating the toner particles so that they coalesce.

21. A method according to claim 17 wherein forming the toner layer comprises forming the layer on an intermediate transfer member of the electrostatographic printing press.

22. A method according to claim 11 wherein forming the at least one first electrode comprises printing the at least one first electrode.

23. A method according to claim 22 wherein printing the at least one first electrode comprises electrostatographic printing.

24. A method according to claim 11 wherein forming the at least one second electrode comprises printing the at least one second electrode.

25. A method according to claim 24 wherein printing the at least one second electrode comprises electrostatographic printing.

* * * * *